US006679731B2

(12) United States Patent
Chang

(10) Patent No.: US 6,679,731 B2
(45) Date of Patent: Jan. 20, 2004

(54) ELECTRIC CONNECTOR WITH AN AUXILIARY SHIELD

(75) Inventor: Che-Chia Chang, Taipei (TW)

(73) Assignee: Comax Technology Inc., Taipei (TW)

( * ) Notice: Subject to any disclaimer, the term of this patent is extended or adjusted under 35 U.S.C. 154(b) by 0 days.

(21) Appl. No.: 10/175,917

(22) Filed: Jun. 21, 2002

(65) Prior Publication Data

US 2003/0181103 A1 Sep. 25, 2003

(30) Foreign Application Priority Data

Mar. 21, 2002 (TW) ..... 91203453 U

(51) Int. Cl.[7] ..... H01R 13/648

(52) U.S. Cl. ..... 439/609; 439/92

(58) Field of Search ..... 439/609, 607, 439/92

(56) References Cited

U.S. PATENT DOCUMENTS 5,975,957 A * 11/1999 Noda et al. ..... 439/609

* cited by examiner

*Primary Examiner*—Gary Paumen
(74) *Attorney, Agent, or Firm*—Troxell Law Office PLLC

(57) ABSTRACT

An auxiliary shield for an electric connector is disposed between a shield device on a casing of an electronic apparatus and the electric connector. The shield device has a plurality of first pierced openings and fixing holes and the first pierced openings correspond to contacts of the electronic apparatus. The shield device has a bended joint part located adjacent to the casing of the electronic apparatus. The auxiliary shield has a plurality of second pierced openings corresponding to the first pierced openings on the shield device and at least a plurality of elastic strips extending along a side of each of the pierced openings for pressing against a metal casing of the electric connector. The shield device evenly contacts with the electric connector completely such that an external connecting circuit of the electronic apparatus is hidden.

6 Claims, 4 Drawing Sheets

ELECTRIC CONNECTOR WITH AN AUXILIARY SHIELD

BACKGROUND OF THE INVENTION

1. Field of the Invention

The present invention relates to an electric connector with an auxiliary shield, and particularly to an auxiliary shield provided in the electric connector to allow a shield device evenly connecting with the electric connector completely for external connecting path of an electronic apparatus being hidden effectively.

2. Description of Related Art

Due to the electronic technology progressing incessantly, a lot of electronic apparatuses are indispensable products in our lives. However, the electronic apparatus such as the computers generate electromagnetic waves while in operation and the electromagnetic waves are harmful our bodies' health and cause interferences to damage other electronic parts in addition to interfering other electric appliances. Hence, how to shield the electromagnetic waves from the electronic apparatuses is one of vital subjects many manufactures focus on.

The conventional shield device as shown in FIG. 1 has a metal body 1 with an end thereof provided with a bended engaging part 11. The engaging part 11 can be mounted to a casing of the electronic apparatus (not shown) and a plurality of pierced openings 12 are disposed in the metal body 1 to correspond to contacts on the electronic apparatus. After the electric connector (not shown) being inserted into the electronic apparatus, fixing holes on the electric connector can be aligned with fixing holes 13 in the body 1. Fasteners are utilized to engage with the fixing holes such that the electric connector can be fixedly attached to the body 1 and the metal casing of the electric connector can contact with the body 1. In this way, it is possible to obtain an effect of shield.

However, the preceding metal body 1 has to make the pierced openings 12 and the fixing holes 13 so that it is very easy to result in an uneven surface on the body 1 and the metal casing of the electric connector being unable to contact with the body 1 entirely. Moreover, all the contacts on the electric connector have to be covered with plastics during being made so that the contacts provide inconsistent levels because of the plastic covers to constitute the electric connector itself and the contacts do not contact with the body 1 completely. Therefore, the problem of interference caused by the electromagnetic are not truly solved.

SUMMARY OF THE INVENTION

Accordingly, an object of the present invention is to provide an auxiliary shield for an electric connector, with which the support frame can evenly contact with the electric connector completely.

Another object of the present invention is to provide an auxiliary shield for an electric connector, with which the external connecting circuit of the electronic apparatus can be hidden effectively.

For reaching the above said objects, the crux of the present invention resides in that the auxiliary shield for an electric connector is provided with a plurality of pierced openings corresponding to the pierced openings of a shield device and at least a plurality of elastic strips extends along a side of each of the pierced openings for being pressed against a metal casing of the electric connector such that the support frame can evenly contact with the electric connector completely with an external connecting circuit of the electronic apparatus being hidden effectively.

BRIEF DESCRIPTION OF THE DRAWINGS

The present invention can be more fully understood by reference to the following detailed description and accompanying drawings, in which.

DETAILED DESCRIPTION OF THE PREFERRED EMBODIMENTS

Figure 1:
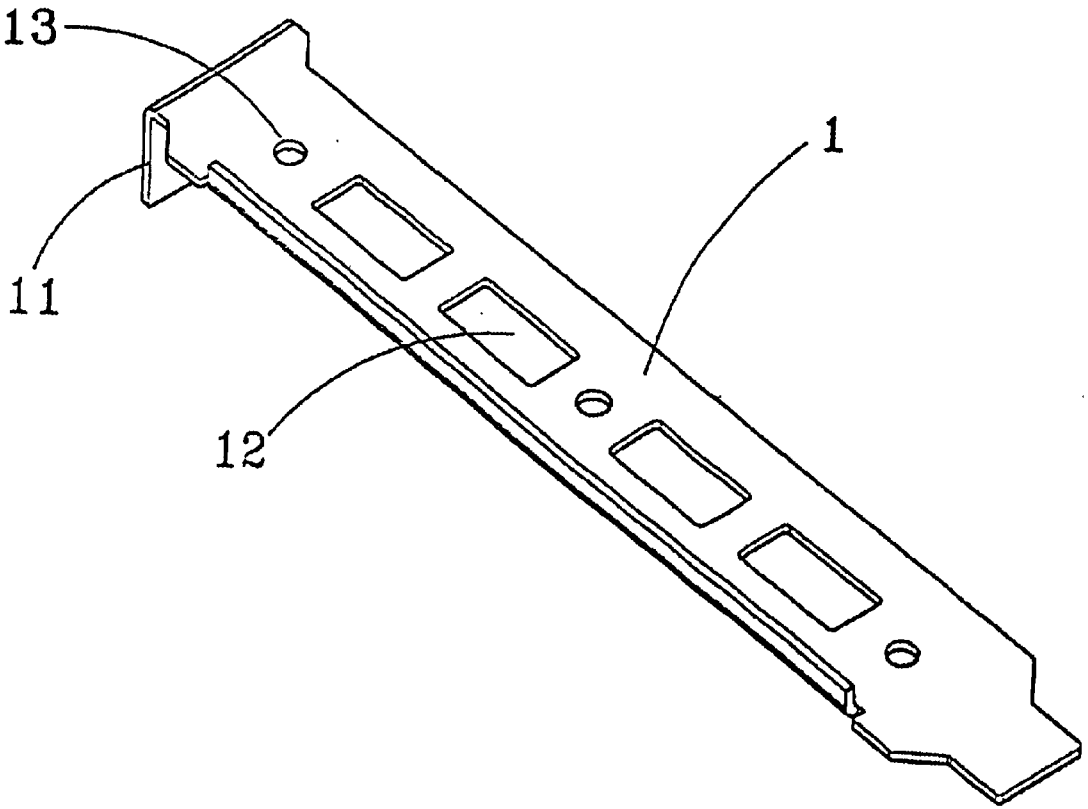
FIG. 1 PRIOR ART
FIG. 1 is a perspective view of a conventional auxiliary shield for an electric connector.
Figure 2:
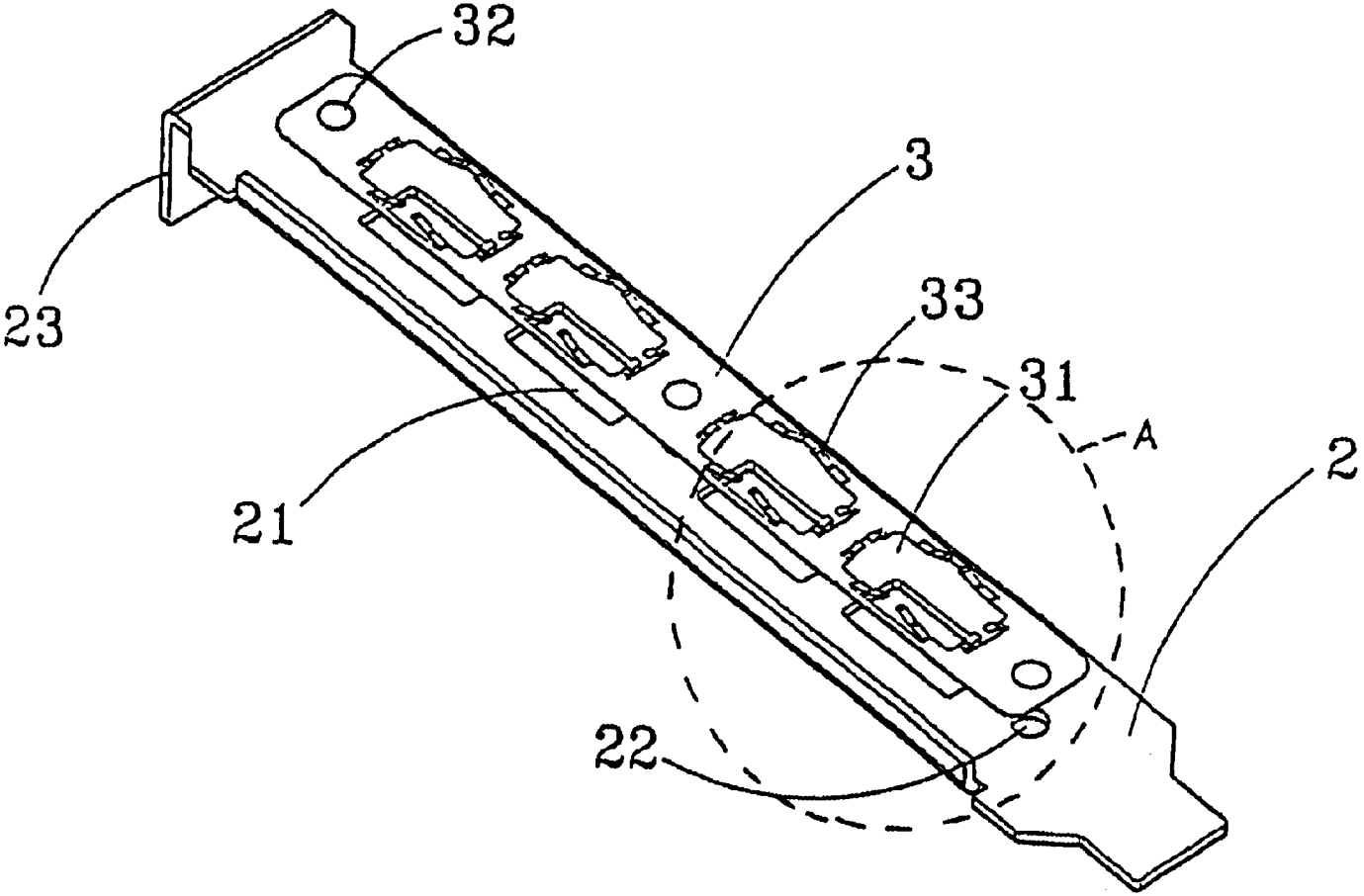
FIG. 2 is an exploded perspective view of an auxiliary shield for an electric connector according to the present invention.
Figure 3:
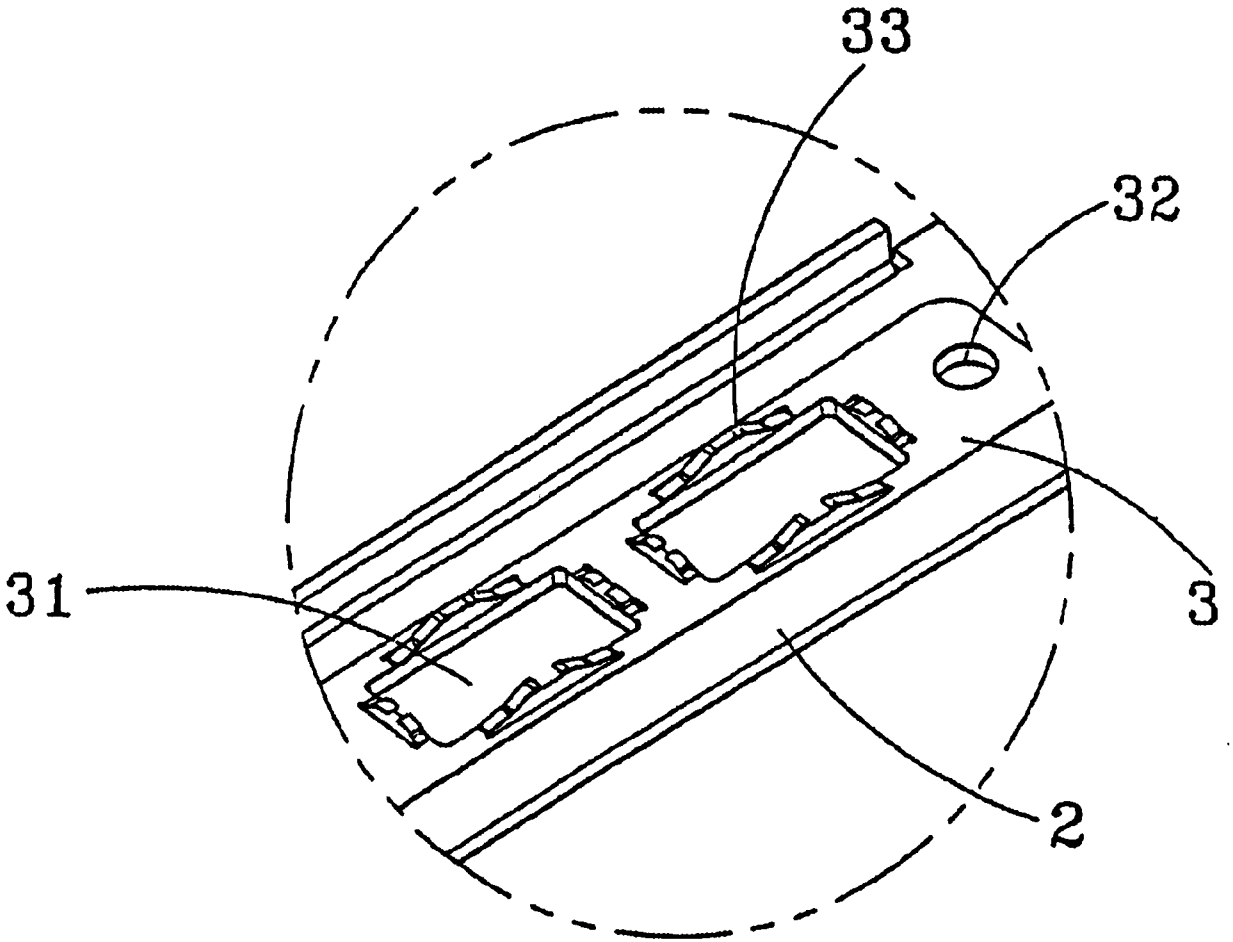
FIG. 3 is a fragmentary enlarged perspective view of area A in FIG. 2.

Referring to FIGS. 2 and 3, the invention is an auxiliary shield for an electric connector and the auxiliary shield 3 is mounted between a shield device 2 on a casing of an electronic apparatus (not shown) and the electric connector such that the shield device 2 can evenly contact with the electric connector completely for the external path of the electronic apparatus being hidden effectively.

The preceding shield device 2 is provided with a plurality of pierced openings 21 and fixing holes 22. The pierced openings 21 are corresponding to contacts of the electronic apparatus and an end of the shield device 2 is provided with a bended joint part 23.

The auxiliary shield 3 is provided with a plurality of pierced openings 31 corresponding to the pierced openings 21 on the shield device 2 and is provided with a plurality of holes 32 corresponding to the fixing holes 22. The pierced openings 31 at least at a respective lateral side thereof extend a plurality of elastic strips 33 corresponding to the pierced openings 31 for being urged against the metal casing of the electric connector. Of course, the elastic strips 33 can be disposed to surround the periphery of each pierced opening 31, at two neighboring sides of every two adjacent pierced openings 31 or at two opposite sides of every pierced opening 31. As the foregoing structure, the auxiliary shield for an electric connector can be formed completely.

Figure 4:
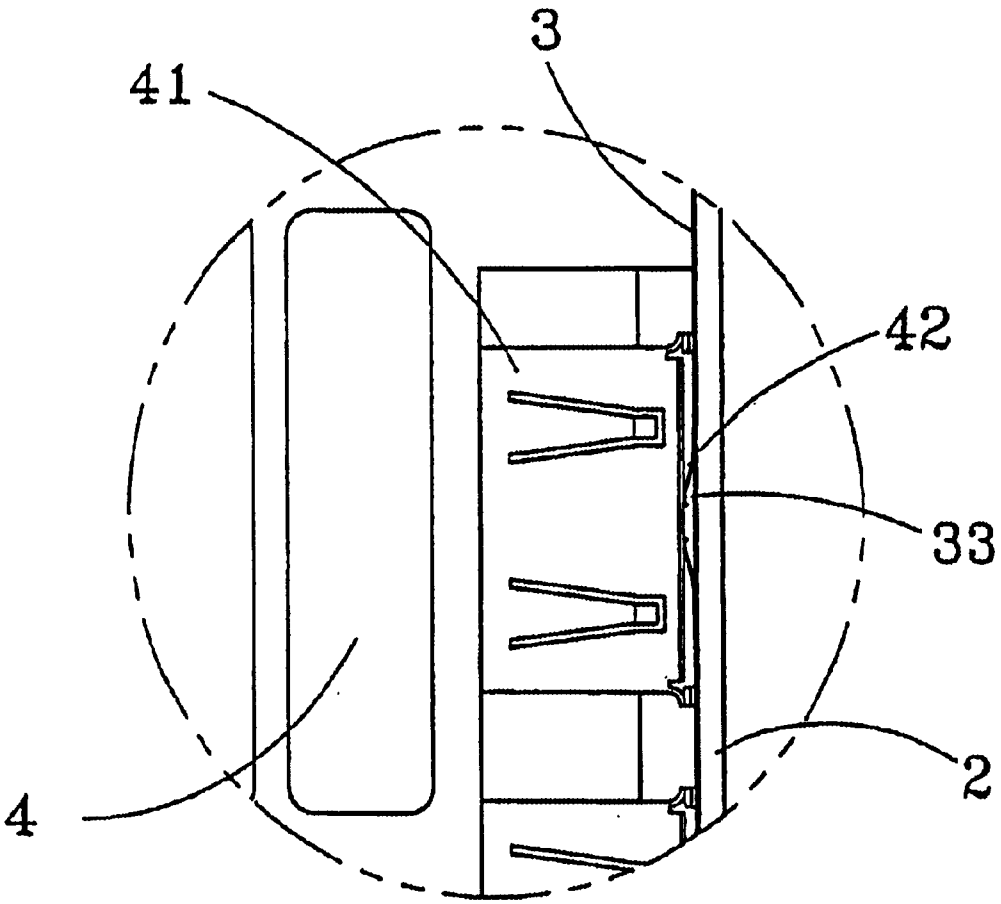
FIG. 4 is a fragmentary sectional view of the present invention showing the electric connector.

Referring to FIGS. 2, 3 and 4, while the auxiliary shield of the present invention is in use, the first thing has to be done is to align the pierced openings 31 with the pierced openings 21 on the shield device 2 and to align the holes 32 on the auxiliary shield 3 with the fixing holes 21 on the shield device 2. In the meantime, the contact 41 of the electric connector 4 can be inserted into the joint of the electronic apparatus. Finally, fasteners (not shown) are engaged to the holes 32 and the fixing holes 22 such that the electric connector 4 can be fixedly attached to the shield device 2 to complete the assembly job. Due to the contact 41 at both lateral sides thereof having two bended contact pieces 42, the elastic strips 33 at the sides of the pierced openings 31 can press against both the metal casing of the contact 41 and the contact pieces 42. In this way, the shield device 2 can evenly contact with the metal casing of the contact 41 on the electric connector 4 completely such that the external connecting path of the electronic apparatus can be hidden effectively.

While the invention has been described with reference to the a preferred embodiment thereof, it is to be understood that modifications or variations may be easily made without departing from the spirit of this invention, which is defined by the appended claims.

What is claimed is:

1. An auxiliary shield for a shield device on a casing of an electronic apparatus, the shield device having a plurality of first pierced openings and a plurality of fixing holes, the auxiliary shield comprising:

a) an auxiliary shield body on the shield device and having a plurality of second pierced openings aligned with the plurality of first pierced openings in the shield device; and b) a plurality of elastic strips located on at least two sides of each of the plurality of second pierced openings in the auxiliary shield body, the elastic strips extending obliquely to the auxiliary shield body.

2. The auxiliary shield according to claim 1, further comprising a plurality of holes in the auxiliary shield body aligned with the plurality of fixing holes in the shield device.

3. The auxiliary shield according to claim 1, wherein the plurality of elastic strips are located on two adjacent sides of each of the plurality of second pierced openings.

4. The auxiliary shield according to claim 1, wherein the plurality of elastic strips are located on opposing sides of each of the plurality of second pierced openings.

5. The auxiliary shield according to claim 1, wherein the at least two sides of each of the plurality of second pierced openings includes four sides.

6. The auxiliary shield according to claim 5, wherein the plurality of elastic strips are located on all four sides of the second pierced openings.

* * * * *